US005729850A

United States Patent [19]

Eskeli

[11] Patent Number: 5,729,850

[45] Date of Patent: Mar. 24, 1998

[54] STRETCHER

[75] Inventor: Lassi Eskeli, Rusko, Finland

[73] Assignee: Tarpaulin Ky, Rusko, Finland

[21] Appl. No.: 750,068

[22] PCT Filed: May 30, 1995

[86] PCT No.: PCT/FI95/00300

§ 371 Date: Dec. 3, 1996

§ 102(e) Date: Dec. 3, 1996

[87] PCT Pub. No.: WO95/33430

PCT Pub. Date: Dec. 14, 1995

[30] Foreign Application Priority Data

Jun. 3, 1994 [FI] Finland ..... 942621

[51] Int. Cl.[6] ..... A47B 1/00

[52] U.S. Cl. ..... 5/621; 5/625; 5/627; 5/628

[58] Field of Search ..... 5/620, 621, 625, 5/627, 628

[56] References Cited

U.S. PATENT DOCUMENTS

| | | | |
|---|---|---|---|
| 722,456 | 3/1903 | Reeves | 5/628 |
| 2,350,573 | 6/1944 | Smith, Jr. et al. | 5/628 |
| 2,361,328 | 10/1944 | Springer | 5/628 |
| 2,410,181 | 10/1946 | Peters | 5/625 |
| 2,489,828 | 11/1949 | Springer | 5/625 |
| 2,788,530 | 4/1957 | Ferguson . | |
| 2,899,692 | 8/1959 | Finken | 5/628 |
| 3,158,875 | 12/1964 | Fletcher . | |
| 4,124,908 | 11/1978 | Burns et al. . | |
| 4,601,075 | 7/1986 | Smith . | |
| 4,679,260 | 7/1987 | Frettem | 5/628 |
| 4,889,113 | 12/1989 | Pelloux-Gervais . | |
| 5,050,254 | 9/1991 | Murphy | 5/625 |
| 5,121,514 | 6/1992 | Rosane | 5/625 |
| 5,189,746 | 3/1993 | Horic . | |
| 5,279,878 | 1/1994 | Föttinger et al. . | |

FOREIGN PATENT DOCUMENTS

| | | | |
|---|---|---|---|
| 1069183 | 9/1984 | Finland . | |
| 522691 | 4/1931 | Germany | 5/628 |
| 92208 | 8/1958 | Norway | 5/628 |
| 1472272 | 5/1977 | United Kingdom . | |
| 2157574 | 10/1985 | United Kingdom . | |
| 2157957 | 11/1985 | United Kingdom . | |
| WO 95/03026 | 2/1995 | WIPO . | |

*Primary Examiner*—Steven N. Meyers
*Assistant Examiner*—Tueyet-Phllong Pham
*Attorney, Agent, or Firm*—Nixon & Vanderhye P.C.

[57] ABSTRACT

A stretcher for moving, particularly in narrow spaces, injured and sick persons is constructed with a minimum of fastening elements, and with advantageously located hand holds. A flexible sheet material has a first portion with a width greater than a patient's breast area and a second portion with a width greater than a patient's leg area, but less than the breast area portion. At least one bottom stiffener is attached to the sheet, and reinforcing straps are attached to the bottom surface of the sheet. Longitudinal support elements (preferably with stiffeners) are connected along the longitudinal edges of the sheet, and fastening straps (as least some of which are adjustable) extend between the longitudinal straps and the longitudinal support elements. A minimum number of fasteners extend from the longitudinal support elements to be connected together and thereby hold the sheet wrapped around the person. The reinforcing straps provide hand holds along the side and define a carrying sling adjacent the person's head.

19 Claims, 4 Drawing Sheets

STRETCHER

The present invention relates to a stretcher for moving injured or sick persons, in particular in narrow spaces, which stretcher comprises a base made of flexible sheet material, such as cloth or plastic, means for securing the patient to the base and carrying means for carrying the stretcher.

In many situations, for instance on ships, it is necessary to transport a patient on a stretcher in narrow spaces, along narrow staircases or through small portholes, or lift or lower a patient in an upright position. The patient can usually not be moved safely carried on a conventional stretcher. A conventional stretcher is too wide and too long. Therefore patients have to be carried in various improvised ways. Often a conventional stretcher is so large in itself that it is difficult to place it beside the patient, let alone to move it with the patient. The bars alone, the carrying means of the conventional stretcher, take up a great deal of space both in the lateral and the longitudinal directions.

The patient is strapped on the stretcher when the stretcher is being moved. Generally, loose straps are then used, which are difficult to fasten to the correct places in the stretcher. If the patient has to be moved in an oblique position, for instance in narrow staircases, the patient has to be tied very tightly to the stretcher to prevent him from slipping down to the lower part of the stretcher. The tight straps may considerably aggravate the condition of the patient. To lift a patient when he is in an upright position by means; of a conventional stretcher is very cumbersome.

It is an object of the present invention to provide a stretcher which is better than those of the prior art.

It is a particular object of the invention to provide a stretcher on which a patient can also be moved in narrow spaces, even with the patient in a vertical position, and without the stretcher substantially bending.

In order to achieve the above mentioned objects the invention is characterized by the features defined in the appended claims.

The stretcher according to the invention thus comprises a base which is made of flexible sheet material, such as fireproof PVC plastic or other material suitable for this purpose. The base is made of a protecting sheet which is at least partly wider than the patient to be carried and which at the breast height of the patient is wider than at the leg height of the patient.

The protecting sheet should at least partly protect the sides of the patient. Preferably the protecting sheet is so large that it protects the side of the body substantially completely and at least a portion of the front side of the body, i.e. at least a portion of the breast, the abdomen region and the legs of the patient. The protecting sheet will then support the patient along the whole body and part of the legs, wherefore straps are not needed to the same extent as when the patient is tied to an open stretcher.

The downwards, against the foot-end, narrowing shape forms a conical or torso-shaped space for the patient inside the protecting sheet. The protecting sheet, which is firmly disposed around the patient, will then prevent the patient from slipping to the narrower foot-end even when he is in a vertical position while being lifted.

The base is provided with fastening means, by means of which the edges of the protecting sheet are secured around the patient. Thanks to the shape of the protecting sheet, the patient does not have to be tied as firmly to the base with these fastening means as with the straps in a conventional stretcher.

In the protecting sheet there is further disposed one or several bottom stiffeners, such as plywood slats or the like, in the longitudinal direction of the patient, which stiffen the bottom of the base. The bottom stiffener keeps the bottom of the base straight and prevents the base from bending downwards by the weight of the patient. Preferably, there are three adjacent bottom stiffeners, the middlemost of which is slightly longer at its both ends than the stiffeners at the sides.

The bottom stiffeners can be made of plywood, for instance of 5–15 cm wide plywood slats, or from other suitable rigid material. The bottom stiffeners can be secured to the base, for instance so that a strap which is slightly wider and longer than the stiffener is sewn or otherwise attached to the surface of the protecting sheet so as to form a pocket for the stiffener. A stretcher provided with adjacent, parallel bottom stiffeners is robust and does not sag in the middle. The fact that the base is stiffened by separate stiffening elements renders it possible to fold, i.e. to "roll", the base so that the stretcher during storage or when transported empty occupies a minimum of space.

The base is preferably provided with at least two fastening means by which the edges of the protecting sheet are secured against each other around the patient. One of the fastening means is preferably disposed at the breast height of the patient and the other at the leg height. When additional side stiffeners are disposed at the edges of the protecting sheet, inside the bent edges, it is possible to secure the patient safely to the stretcher by means of these two fastening means.

The fastening means are preferably formed of three straps so as to be adjustable. The straps are at one end attached to the protecting sheet, for instance to a longitudinal support strap attached to the protecting sheet. At the other end, the straps are attached to a longitudinal support element, such as a PVC slat coated with cloth or plastic. The fastening element or clasp is disposed on this support element. The fastening straps can be pre-adjusted so as to be suitable for a person of a certain size. The stretcher is, due to its structure, suitable for use without any adjustment also for slightly smaller or larger persons. The adjusted straps can be fastened very quickly. The straps can on the other hand be provided with very simple adjustment mechanisms which anybody can easily use, when necessary.

The support elements as well as the stiffeners inside the edges of the protecting sheet contribute towards holding the protecting sheet firmly around the patient. Usually it is then sufficient that the edges of the protecting sheet are secured to each other by two or even one fastening element or clasp. The clasps can be very simple, for instance clasps which can be connected to each other by pressing, whereby even in case of utter emergency, the patient can be quickly and safely secured on the stretcher.

A reinforcing strap substantially of the same length as the protecting sheet, to which for instance the above mentioned fastening straps can be attached, is preferably attached to the outer surface of the protecting sheet. The reinforcing strap can substantially along its whole length be sewn or otherwise attached to the protecting sheet forming the base. A portion of the reinforcing strap can be left unattached to the protecting sheet, for instance at the regions of the breast and the legs of the patient, whereby the reinforcing strap in these places can be used as a carrying hand-hold.

The reinforcing strap can be left altogether unattached at the head-end of the base and be arranged to run slidably there in a protecting sleeve formed in the protecting sheet. The length of the reinforcing strap can then be adjusted in the head-end of the stretcher, and if required, the head-end can be sufficiently opened and again closed. The reinforcing straps of both sides are preferably connected to each other above the head-end in a carrying sling.

In the head-end of the base there are preferably separate head protectors. The head protectors can be movably connected to the base by means of straps attached thereto. The straps are arranged to run through the head protectors in passages or tunnels formed therein. In this way, the location of the head protectors can, when necessary, be adjusted by moving the head protector along the strap. The straps are attached to the base so that the head protector chiefly protects the sides of the head, the regions of the ears and the temples and the sides of the face. A small cushion can further be immovably disposed on the bottom of the base at the location of the head of the patient.

The stretcher according to the invention takes up very little space when stored or in use. The stretcher does not have to be, due to its structure, wider than the shoulder width of the patient. The stretcher can preferably even be designed so that there are openings at the patient's shoulder region in the protecting sheet forming the base so that the protecting sheet supports the back and the breast of the patient at the region of the shoulders, but leaves the sides of the shoulders uncovered. The patient can then hold his arms either outside or inside the protecting sheet. In this way, the patient can be moved very smoothly in narrow spaces. In some cases it may be of advantage if the patient can help or steer the moving of the stretcher with his hands, thereby preventing additional injuries.

Other important advantages of the arrangement according to the invention which can be mentioned are the stiffness of the stretcher and the torso-shaped space for the patient. Although the stretcher is made of flexible material and although it can be folded, it is stiff and holds the backbone of the patient straight in all kind of lifting positions. The torso-shaped or conical space for the patient prevents the patient from sliding to the foot-end of the stretcher.

The structure of the stretcher allows various ways of carrying the stretcher. The stretcher can be carried by the reinforcing straps at the sides or by carrying slings formed by the reinforcing straps at the head-end as well as at the foot-end. If desired, carrying slings can also be attached to the bottom of the base, to which conventional carrying straps (piano carrying straps) can be fastened.

The invention will now be described more in detail with reference to the accompanying drawing, on which FIG. 1 is a perspective front view of a stretcher according to the invention in use;

Figure 1:
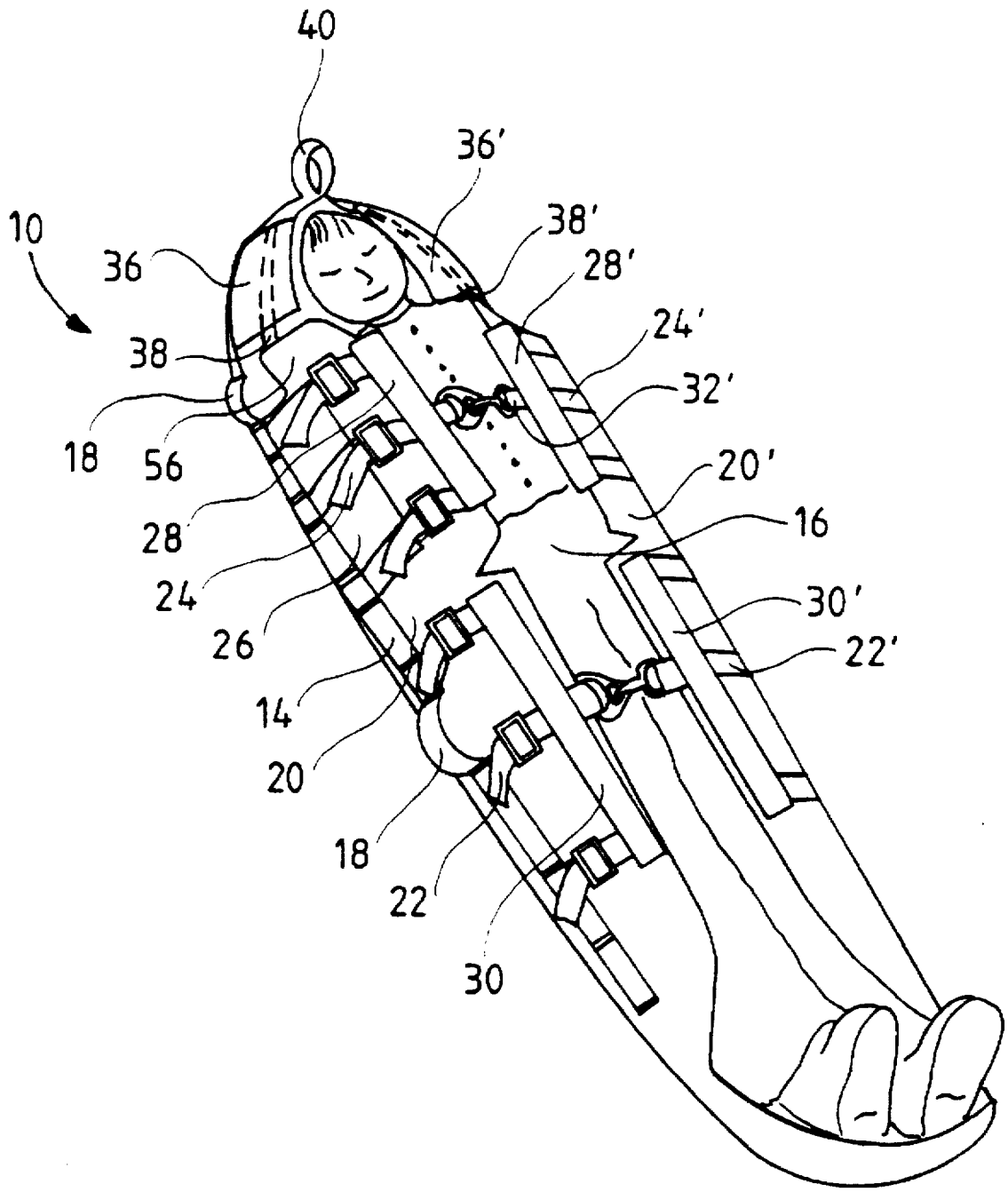

FIG. 1 shows a stretcher 10 comprising a base made of a protecting sheet 12. Reinforcing straps 14, 14' are attached to both sides of the base, which straps at one point in the region of the patient's 16 breast and legs are unattached to the protecting sheet, thereby forming carrying hand-holds 18, 18' (the reinforcing strap 14' on the other side of the stretcher can not be seen in FIG. 1). The sides 20, 20' of the protecting sheet forming the base are turned up partly around the patient. Fastening straps 22, 22', 24, 24' are connected to the reinforcing straps 14. The fastening straps 22 and 22' are connected to the reinforcing straps 14, 14' directly, and the fastening straps 24, 24' through a connecting piece 26. The fastening straps 22, 22', 24, 24' are connected to support elements 28, 28', 30, 30', to which fasteners 32, 34 are attached.

Padded protectors 36, 36' for the sides of the head are disposed in the upper part of the stretcher. The protectors for the sides of the head are trod on straps 38, 38' attached to the protecting sheet so that they can be moved in the longitudinal direction of the stretcher when required. A carrying sling 40 is further formed of the reinforcing straps 14, 14' in the head-end of the stretcher.

Figure 2:
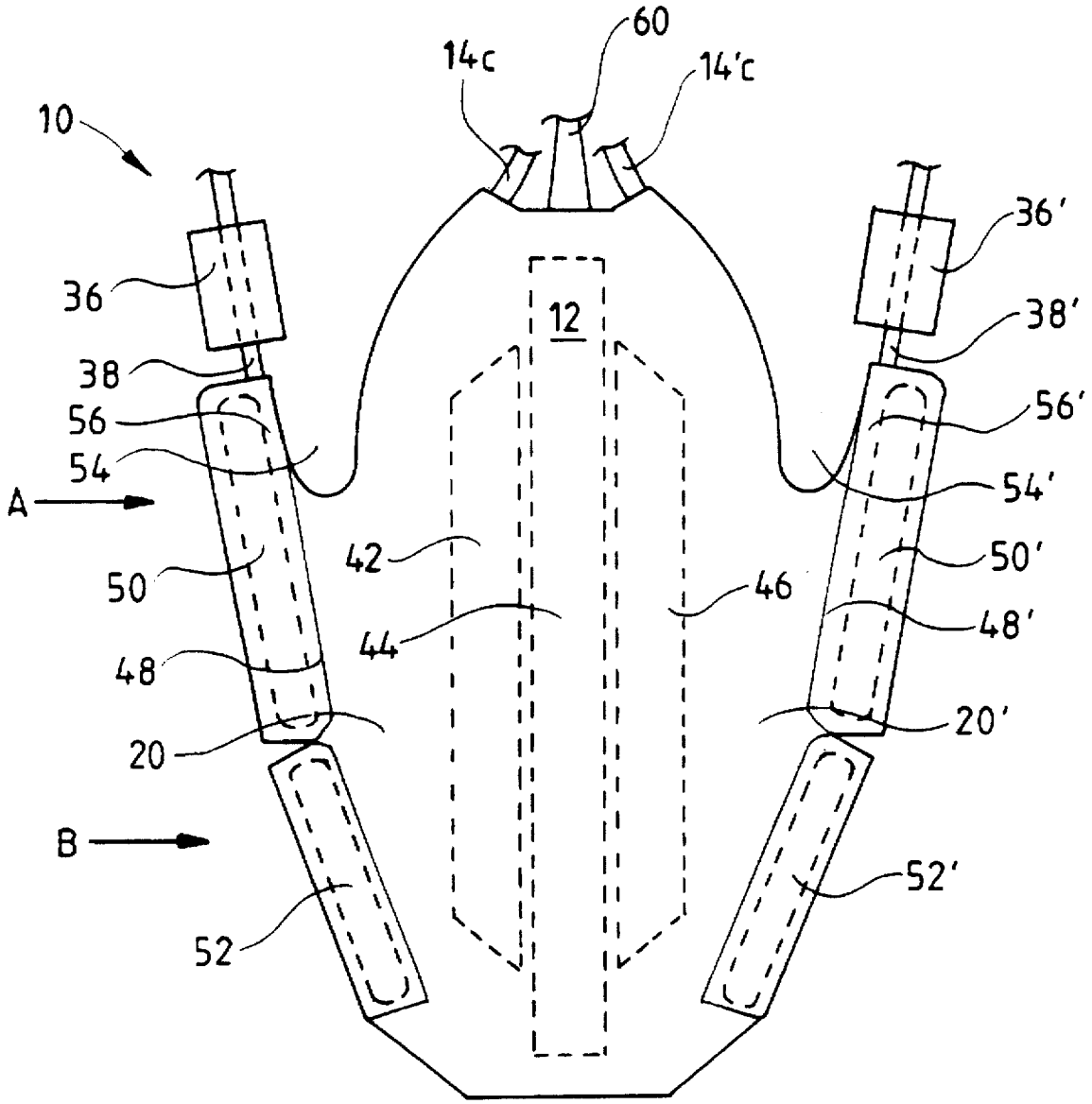
FIG. 2 is a plan view of the base forming a stretcher according to the invention in its opened out form, seen from the inside.
Figure 3:
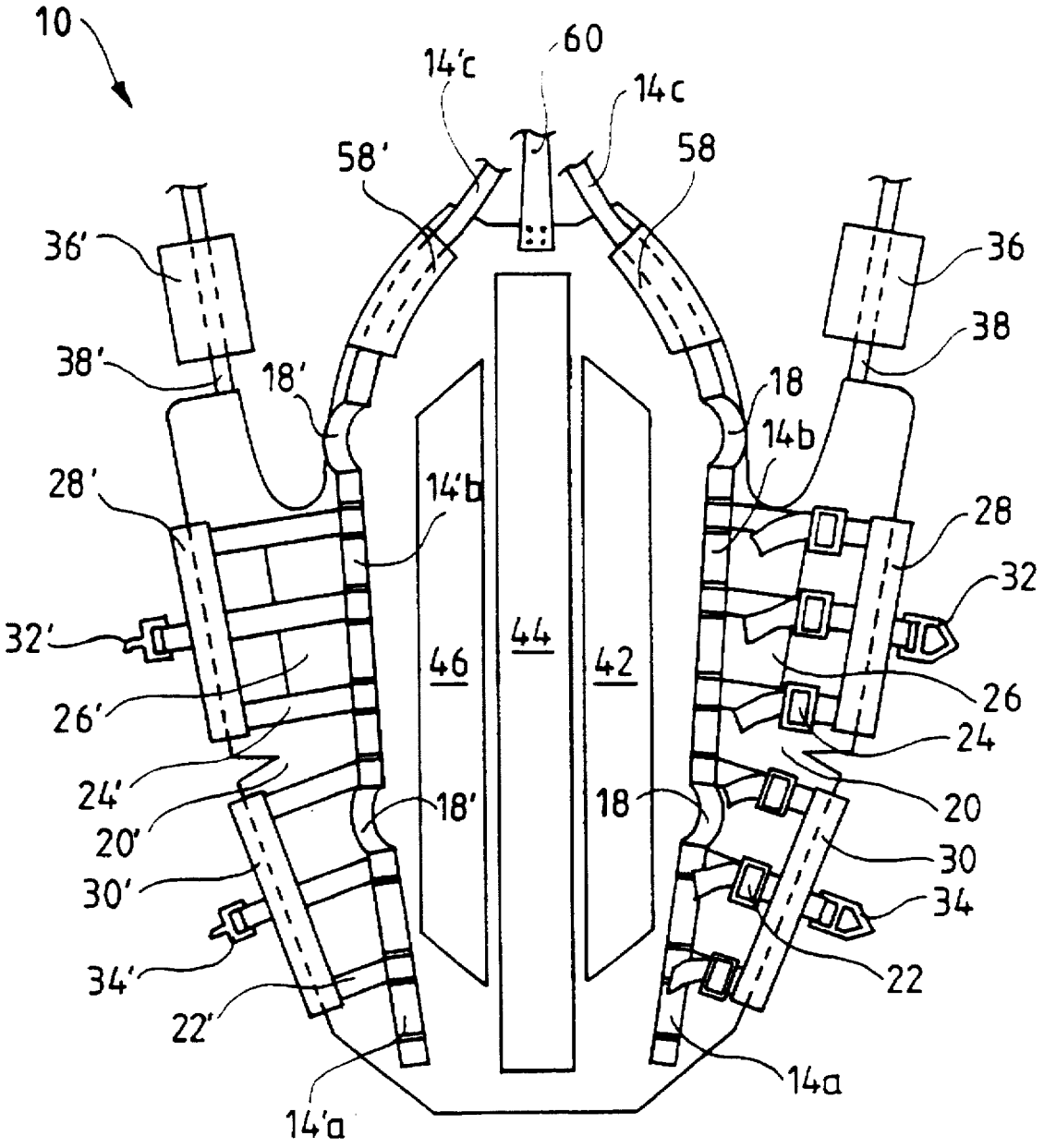
FIG. 3 is a view similar to FIG. 2 but seen from the outside.

FIGS. 2 and 3 show the base forming the stretcher in its opened condition, seen from the inside and the outside. FIG. 2, shows that the protecting sheet 12 forming the base is wider at breast height A of the patient than at leg height B. The figures show bottom stiffeners 42, 44, 46 attached to the bottom of the base, to the outer surface of the protecting sheet. The bottom stiffeners are attached to the protecting sheet by broad straps which are attached by sewing or gluing to the protecting sheet so that the stiffeners are located between the protecting sheet and the straps. These straps are however not shown in FIG. 2 or 3. The bottom stiffener 44 is at its both ends longer than the bottom stiffeners or additional stiffener 42 and 46 beside it, wherefore it is easy to make the base tapered at both ends.

In FIG. 2, it can be seen that the edges 48 and 48' of the protecting sheet are folded double and side stiffeners 50, 50', 52, 52' are disposed between the folds.

In FIGS. 2 and 3 can also be seen the shape the protecting sheet, wherein openings 54, 54' have been formed in the sides of the protecting sheet in the region of the patient's shoulders, through which openings the arms of the patient can be put outside the protecting sheet. When the stretcher is used, the flaps 56 and 56' of the protecting sheet, which extend beyond the shoulders, are turned over the breast of the patient, as can be seen in FIG. 1.

In FIG. 3, it can further be seen that the reinforcing straps 14 and 14', which at their central parts **14*b*, 14*b'* and at their ends 14*a*, 14*a'* at the foot-end are firmly attached to the protecting sheet, are free at their ends 14*c*, 14*c'* at the head-end and can move in sleeves 58, 58', which are formed near the edges of the protecting sheet. A part 60 of the strap to be connected to the carrying sling is further attached to the protecting sheet at its headend. The straps 14*c*, 14*c'*, 38, 38' and 60** form a strong carrying means supporting the stretcher at each side.

Figure 4:
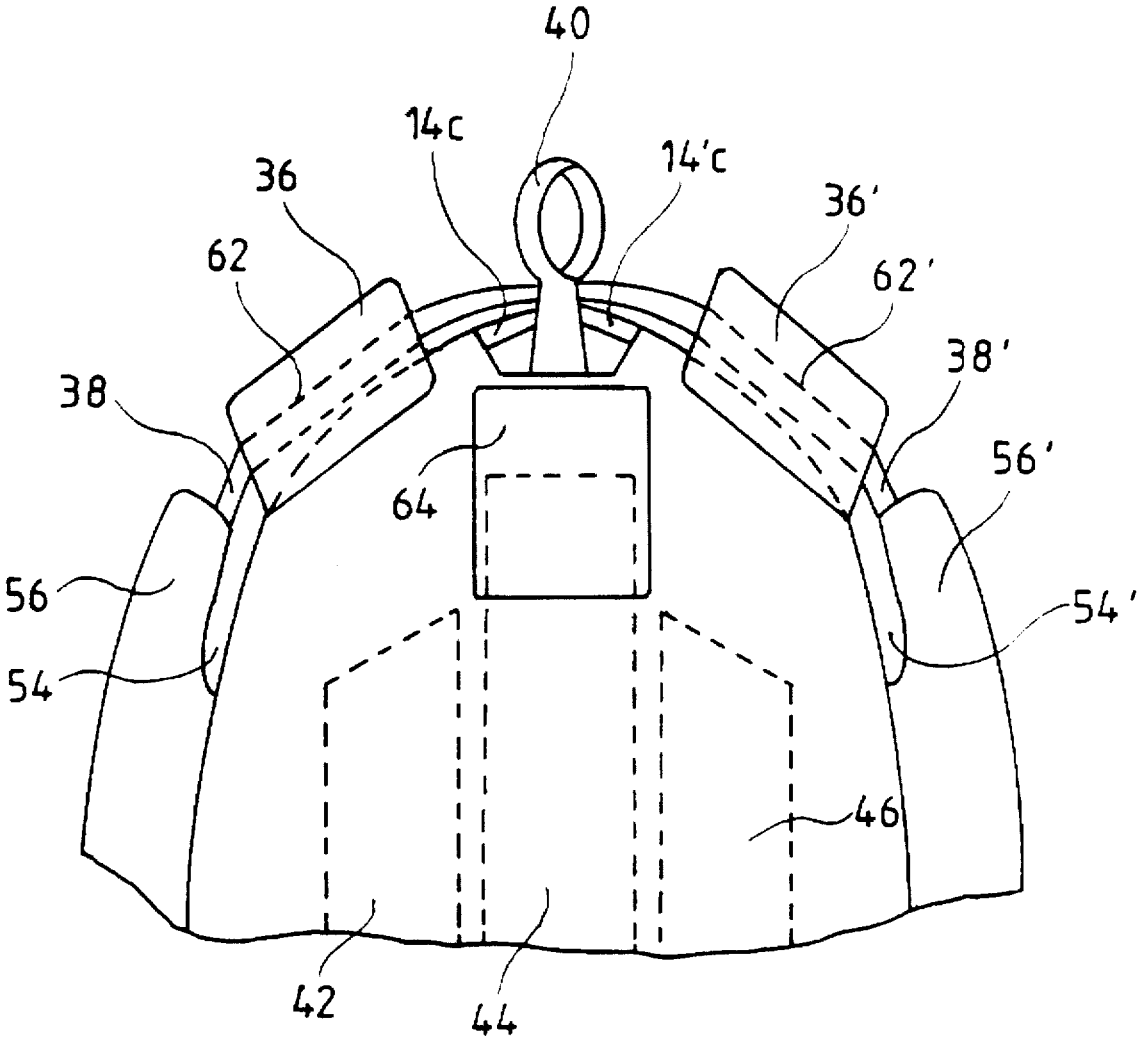
FIG. 4 is a view of the head-end of the base of FIG. 2 and the head protectors connected thereto.

In FIG. 4 can be seen how the head protectors 36, 36' are arranged in the head-end of the base. In the protectors, there are formed tunnels or passages 62, 62' running through them, which allow the protectors to be moved along the straps 38, 38'. A small cushion 64 is further disposed at the head-end of the base.

In the stretcher according to the invention, usually only two (even one may be enough) fastening means 32 and 34 running over the breast of the patient, which greatly facilitate the laying of the patient on the stretcher. Nevertheless, the stretcher holds the patient firmly and safely supported even when the stretcher is moved with the patient in an upright position.

The stretcher according to the invention can preferably be made of a material which can easily be cleaned and disinfected, such as PVC plastic, which is important, for instance on ships, where the stretchers often have to be used in exercises.

I claim:

1. A stretcher for moving, particularly in narrow spaces, an injured or sick person having a breast area and a leg area; said stretcher comprising:

a protecting sheet of flexible sheet material having top and bottom surfaces, first and second outer side surfaces, a first portion with a first width between said first and second outer side surfaces for wrapping around an injured or sick person's breast area, and a second portion with a second width between said first and second outer side surface for wrapping around an injured or sick person's leg area, said first portion being wider than said second portion;

at least one bottom stiffener attached to said sheet and extending in both said first and second width portions, and spaced from said first and second outer side surfaces;

a first reinforcing strap attached to said sheet bottom surface between said first outer side surface and said bottom stiffener;

a second reinforcing strap attached to said sheet second surface between said second outer side surface and said bottom stiffener;

a first longitudinal support element attached to said sheet adjacent said first outer side surface at each of said first and second width portions of said sheet;

a second longitudinal support element attached to said sheet adjacent said second outer side surface at each of said first and second width portions of said sheet;

a first plurality of fastening straps extending between said first reinforcing strap and said first longitudinal support element at each of said first and second width portions of said sheet;

a second plurality of fastening straps extending between said second reinforcing strap and said second longitudinal support element at each of said first and second width portions of said sheet; and first and second cooperating fastener elements connected to said first and second longitudinal support elements at said first width portion of said sheet, and third and fourth cooperating fastener elements connected to said first and second longitudinal support elements at said second width portion of said sheet, said first and second fastener elements for fastening said sheet first width portion in a position where said sheet top surface is wrapped around a sick or injured person's breast area, and said third and fourth fastener elements for fastening said sheet second width portion in a position where said sheet top surface is wrapped around a sick or injured person's leg area.

2. A stretcher as recited in claim 1 wherein said first and second fastener elements are the only fastener elements connected to said first and second longitudinal support elements at said first width portion of said sheet, and said third and fourth fastener elements are the only fastener elements connected to said first and second longitudinal support elements at said second width portion of said sheet.

3. A stretcher as recited in claim 2 wherein said first, second, third and fourth fastener elements are the only fastener elements of said stretcher.

4. A stretcher as recited in claim 2 wherein at least some of said fastening straps are readily adjustable in length.

5. A stretcher as recited in claim 4 wherein both said first and second plurality of said fastening straps extending between said first reinforcing strip and said first longitudinal support elements are readily adjustable in length.

6. A stretcher as recited in claim 4 wherein said first and second plurality of straps each comprise three straps connecting each of said first and second longitudinal elements to said first and second reinforcing straps.

7. A stretcher as recited in claim 1 wherein said first and second reinforcing straps are continuous from said first width portion of said sheet to said second width portion of said sheet and define hand hold portions extending outwardly from said sheet.

8. A stretcher as recited in claim 1 wherein said reinforcing straps are at least substantially the same length as said sheet.

9. A stretcher as recited in claim 8 wherein said reinforcing straps are connected together exteriorly of said sheet closer to said first width portion than said second width portion to define a carrying sling adjacent a sick or injured person's head when said sheet is wrapped around a sick or injured person.

10. A stretcher as recited in claim 9 wherein said reinforcing straps are slidable with respect to said sheet in protecting sleeves adjacent said carrying sling.

11. A stretcher as recited in claim 1 wherein said at least one bottom stiffener comprises first, second and third bottom stiffeners, said first stiffener between and substantially parallel to said second and third stiffeners, and all said stiffeners between said reinforcing straps.

12. A stretcher as recited in claim 11 wherein said first stiffener is longer than said second and third stiffeners, and extends substantially the length of said sheet.

13. A stretcher as recited in claim 1 wherein said bottom stiffeners are attached to said sheet bottom surface, and said first and second plurality of fastening straps engage only said sheet bottom surface not said sheet top surface.

14. A stretcher as recited in claim 1 further comprising stiffeners provided with said first and second longitudinal support elements for stiffening said elements.

15. A stretcher as recited in claim 1 wherein said first plurality of fastening straps are affixed to said first reinforcing strap and said first longitudinal support element, and wherein said second plurality of fastening straps are affixed to said second reinforcing strap and said second longitudinal support element.

16. A stretcher as recited in claim 15 wherein both said first and second plurality of said fastening straps extending between said first reinforcing strip and said first longitudinal support elements are readily adjustable in length.

17. A stretcher as recited in claim 16 wherein said first and second fastener elements are the only fastener elements connected to said first and second longitudinal support elements at said first width portion of said sheet, and said third and fourth fastener elements are the only fastener elements connected to said first and second longitudinal support elements at said second width portion of said sheet.

18. A stretcher as recited in claim 1 wherein said protecting sheet is made of fireproof PVC plastic, and said bottom stiffener is made of plywood.

19. A stretcher for moving, particularly in narrow spaces, an injured or sick person having a breast area, leg area, and head, said stretcher comprising:

a protecting sheet of flexible sheet material having top and bottom surfaces, a top portion for wrapping around an injured or sick person's head, first and second outer side surfaces, a first portion with a first width between said first and second outer side surfaces for wrapping around an injured or sick person's breast area, and a second portion with a second width between said first and second outer side surface for wrapping around an injured or sick person's leg area, said first portion being wider than said second portion;

at least one bottom stiffener attached to said sheet and extending in both said first and second width portions and spaced from said first and second outer side surfaces;

a first reinforcing strap attached to said sheet second surface between said first outer side surface and said bottom stiffener;

a second reinforcing strap attached to said sheet second surface between said second outer side surface and said bottom stiffener;

a plurality of cooperating fastener elements capable of fastening said sheet first width portion in a position where said sheet top surface is wrapped around a sick or injured person's breast area, and said sheet second width portion in a position where said sheet top surface is wrapped around a sick or injured person's leg area;

wherein said first and second reinforcing straps are continuous from said first width portion of said sheet to said second width portion of said sheet and define a plurality of hand hold portions extending outwardly from said sheet;

wherein said reinforcing straps are connected together exteriorly of said sheet to define a carrying sling adjacent a sick or injured person's head when said sheet is wrapped around a sick or injured person; and wherein said reinforcing straps are slidable with respect to said sheet in protecting sleeves adjacent said carrying sling.

* * * * *